US010697119B2

(12) United States Patent
Kallerdahl et al.

(10) Patent No.: US 10,697,119 B2
(45) Date of Patent: Jun. 30, 2020

(54) METHOD FOR MONITORING A YANKEE CYLINDER USING A GRAPHICAL REPRESENTATION OF A TREATMENT EFFECT

(71) Applicant: Valmet Technologies, Inc., Espoo (FI)

(72) Inventors: Tommy Kallerdahl, Espoo (FI); Michael Bjerke, Espoo (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 141 days.

(21) Appl. No.: 15/925,459

(22) Filed: Mar. 19, 2018

(65) Prior Publication Data

US 2018/0266052 A1 Sep. 20, 2018

(30) Foreign Application Priority Data

Mar. 20, 2017 (EP) ..... 17161808

(51) Int. Cl.

| | |
|---|---|
| ***D21F 7/00*** | (2006.01) |
| ***D21F 5/18*** | (2006.01) |
| ***D21G 9/00*** | (2006.01) |
| ***D21H 27/00*** | (2006.01) |

(52) U.S. Cl.

CPC ..... *D21F 7/003* (2013.01); *D21F 5/181* (2013.01); *D21G 9/0036* (2013.01); *D21H 27/002* (2013.01)

(58) Field of Classification Search

CPC .... D21G 9/0036; D21G 9/0045; D21F 7/003; D21F 5/181; D21F 5/18; D21H 27/002; G01N 33/346; G01N 21/89; F26B 13/00; F26B 25/22; H04N 5/332

See application file for complete search history.

(56) References Cited

U.S. PATENT DOCUMENTS

| | | | | |
|---|---|---|---|---|
| 3,731,520 A * | 5/1973 | Hickman | ..... | D21G 9/0036 73/73 |
| 5,026,458 A | 6/1991 | Beuther | | |
| 5,960,374 A | 9/1999 | Lausier | | |

(Continued)

FOREIGN PATENT DOCUMENTS

| | | |
|---|---|---|
| EP | 3378989 A1 * | 9/2018 |
| WO | 2004109011 A2 | 12/2004 |

OTHER PUBLICATIONS

European Search Report for EP 17161808 dated Sep. 11, 2017.

*Primary Examiner* — Jose A Fortuna
(74) *Attorney, Agent, or Firm* — Stiennon & Stiennon

(57) ABSTRACT

An arrangement and method for monitoring a Yankee cylinder (3). The arrangement comprises a Yankee cylinder (3) arranged in a tissue machine (1) for manufacturing a tissue web (2), a measuring device (10) being a permanent part of the tissue machine (1) and providing a main measuring device for a process control of the tissue machine (1), and at least one data processing unit (15) configured to process measurement data describing the at least one measured property of the moving web (2). The data processing unit (15) is configured to form at least one graphical representation describing a treatment effect performance provided by a heated outer surface (4) of the Yankee cylinder (3) to the web (2) to be manufactured.

11 Claims, 10 Drawing Sheets
(4 of 10 Drawing Sheet(s) Filed in Color)

(56) References Cited

U.S. PATENT DOCUMENTS

| | | | | |
|---|---|---|---|---|
| 6,681,497 | B2 * | 1/2004 | Bria | F23G 7/068 110/163 |
| 6,868,623 | B2 * | 3/2005 | Bjornberg | D21F 5/002 34/269 |
| 7,545,971 | B2 * | 6/2009 | Shakespeare | G01B 11/306 382/141 |
| 10,132,034 | B2 * | 11/2018 | Bjerke | D21F 1/52 |
| 2008/0013818 | A1 * | 1/2008 | Shakespeare | G01B 11/306 382/141 |
| 2015/0299952 | A1 * | 10/2015 | Kalaniemi | D21G 5/00 348/88 |
| 2015/0316432 | A1 | 11/2015 | Figiel | |
| 2018/0266052 | A1 * | 9/2018 | Kallerdahl | D21G 9/0036 |

* cited by examiner

METHOD FOR MONITORING A YANKEE CYLINDER USING A GRAPHICAL REPRESENTATION OF A TREATMENT EFFECT

CROSS REFERENCES TO RELATED APPLICATIONS

This application claims priority on European application EP17161808 filed on Mar. 20, 2017 which is incorporated herein by reference.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement for monitoring a Yankee cylinder comprising a heated outer surface for directing a treatment effect to the moving tissue web to be manufactured.

The invention relates also to a method for monitoring a Yankee cylinder comprising a heated outer surface for directing a treatment effect to the moving tissue web to be manufactured.

A tissue machine comprises a Yankee cylinder that is used for drying a tissue web to be manufactured. The Yankee cylinder comprises a heated outer surface against which the tissue web to be manufactured is brought for drying the tissue web. The tissue web is an example of a fibrous web containing lignocellulose and the tissue machine is an example of a fibrous web manufacturing machine for manufacture a fibrous web. The Yankee cylinder, in turn, provides an example of a fibrous web processing apparatus that is a part of a fibrous web manufacturing machine and comprises a heated treatment surface for directing a treatment effect, i.e. a drying effect, to the moving fibrous web to be manufactured.

For monitoring a condition or a performance of the Yankee cylinder, such as wear of the outer surface of the Yankee cylinder or a drying performance thereof, a surface topography or a drying performance of the Yankee cylinder is monitored. In prior art, the surface topography of the Yankee cylinder has been determined for example with a measurement instrument that is configured to follow the outer surface of the Yankee cylinder and any roughness therein. The measurement instrument like that may for example comprise a micrometer and a buzzer running along a wire tensioned across the outer surface of the Yankee cylinder. The drying performance of the Yankee cylinder has been evaluated for example by using high speed infrared cameras arranged to take infrared pictures of the outer surface of the Yankee cylinder or by using other additional or auxiliary devices intended for the specific purpose to monitor the Yankee cylinder surface.

SUMMARY OF THE INVENTION

An object of the present invention is to provide a novel solution for monitoring the Yankee cylinder.

The solution disclosed is based on the idea of monitoring a treatment effect performance directed by a heated outer surface of a Yankee cylinder to a moving tissue web to be manufactured by means of graphical representations based on measured quality properties of the moving tissue web. The graphical representation relates at least one measured value of the at least one property of the moving tissue web to at least one portion of the heated outer surface of the Yankee cylinder. The properties of the moving tissue web are measured with a measuring device arranged immediately next to the Yankee cylinder in the traveling direction of the tissue web, wherein the measuring device is a permanent part of the tissue machine and provides a main measuring device for a process control of the tissue machine.

With the solution the treatment effect performance of the Yankee cylinder may be visually illustrated, whereby an operator either inside or outside of the factory may consider whether the operation of the Yankee cylinder is normal or not, and thereby detect possible defects or malfunctions in the heated outer surface or in the operation of the Yankee cylinder and consider a reason for the possible malfunctions. The solution is based on using a measurement device or instruments already normally available in the tissue machine, whereby there is no need for specific measurement instruments or measurement arrangements in order to carry out the solution presented.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

In the following the invention will be described in greater detail by means of preferred embodiments with reference to the accompanying drawings.

For the sake of clarity, the figures show some embodiments of the invention in a simplified manner. Like reference numerals identify like elements in the figures.

DESCRIPTION OF THE PREFERRED EMBODIMENTS

Figure 1:
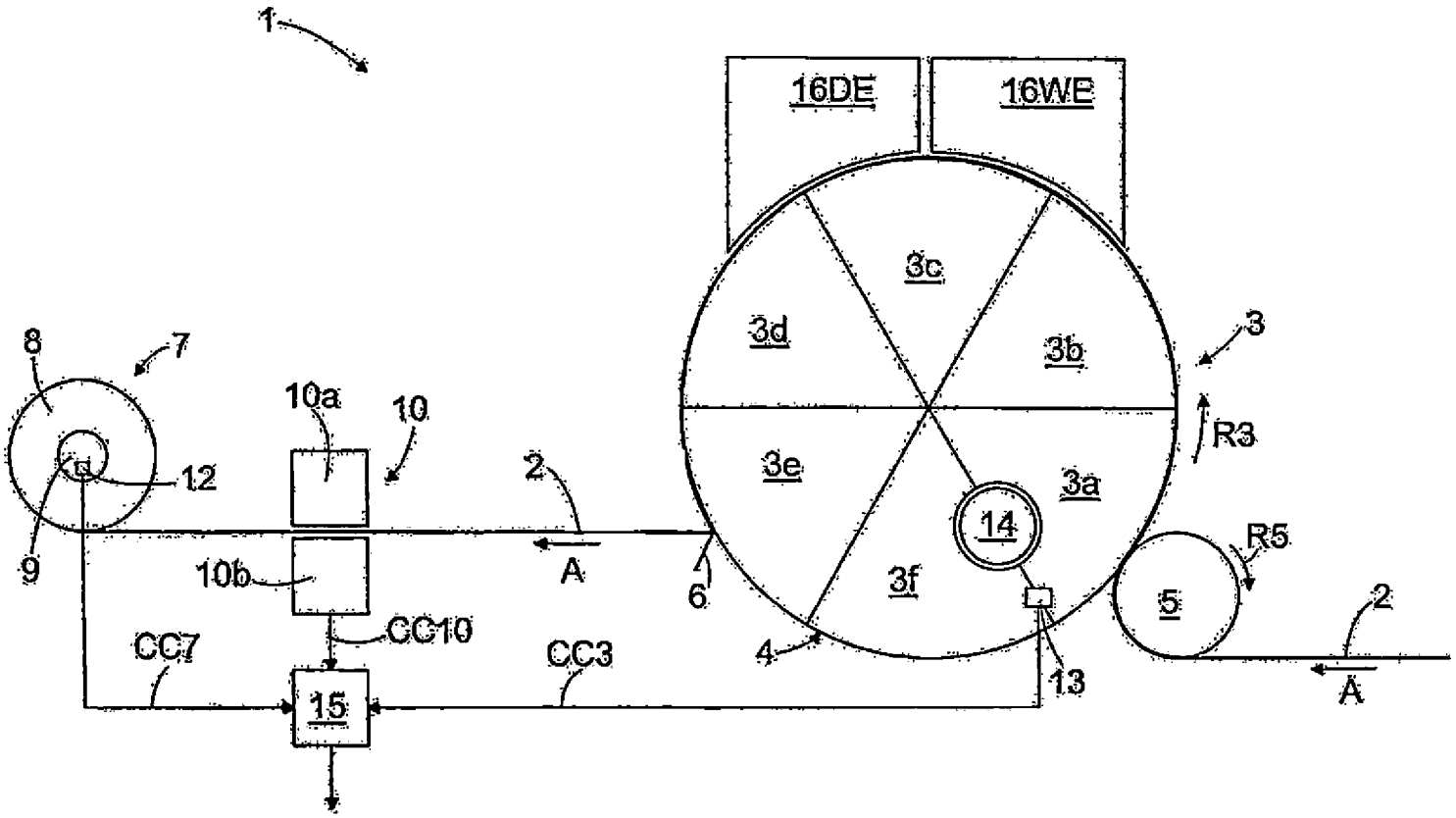
FIG. 1 shows schematically a side view of a part of a tissue machine and a Yankee cylinder therein.

FIG. 1 shows schematically a side view of a part of a tissue machine 1. The tissue machine 1 comprises a headbox for receiving fiber suspension or slush pulp from a pulping process preceding the headbox. The headbox supplies the fiber suspension to a wire section wherein a tissue web 2 is formed of the fiber suspension. For the sake of clarity, the pulping process, the headbox, the wire section and any possible devices therein are not disclosed in the Figures but their general structure and operation is known for a person skilled in the art. The direction of the travel of the tissue web 2 in FIG. 1 is from right to left and indicated with a reference sign A. The tissue machine 1 provides one example of a fibrous web manufacturing machine for manufacturing a fibrous web and the tissue web 2 provides one example of a moving fibrous web to be manufactured.

From the wire section the tissue web 2 is forwarded to a Yankee cylinder station for drying the tissue web 2. The Yankee cylinder station comprises a Yankee cylinder 3 the rotation direction of which is shown with an arrow indicated with a reference sign R3. The Yankee cylinder 3 is a large diameter cylinder filled with hot steam that heats an outer surface 4 or a cylindrical surface 4 of the Yankee cylinder 3. The Yankee cylinder 3 is divided in the circumferential direction thereof into six compartments 3*a*, 3*b*, 3*c*, 3*d*, 3*d*, 3*f* or headers 3*a*, 3*b*, 3*c*, 3*d*, 3*d*, 3*f*. Each compartment or header 3*a*-3*f* comprises a water removal system of its own for removing any condensation water arising inside the Yankee cylinder 3 during its operation.

The tissue web 2 is pressed against the hot outer surface 4 of the Yankee cylinder 3 with a counter roll 5 and a press felt (not shown) traveling via the roll 5. The counter roll 5 can be a suction roll, a press roll with grooved or ungrooved surface, a shoe roll or other type of an extended nip roll. The rotation direction of the roll 5 is shown with an arrow indicated with a reference sign R5.

The tissue web 2 is attached to the hot outer surface 4 of the Yankee cylinder 3. The hot outer surface 4 evaporates water from the tissue web 2, thereby drying the tissue web 2 further by removing from the tissue web 2 water still remaining in the web 2. Any condensation water that may arise inside the cylinder 3 is removed out from the cylinder 2 at the corresponding header 3*a*-3*f* of the cylinder 3. The tissue web 2 attached to the outer surface 4 of the Yankee cylinder 3 and traveling with the outer surface 4 of the cylinder 3 is detached from the Yankee cylinder 3 with a doctor blade 6, also called a creping doctor 6.

The creping doctor 6 is in intimate friction contact with the Yankee surface 4 thus exposing its surface for wearing. Especially when the contact line pressure between the doctor blade 6 and the Yankee surface 4 is uneven the Yankee surface 4 may wear excessively, for example sometimes even showing visible "stripes" in the area or areas of higher blade pressure. It is clear then that the tissue product would not be of uniform quality but has serious defects causing problems in reel-up and further processing. Most often wear of the surface 4 is not visible but still it affects adversely on tissue product quality and further processing of the tissue web.

The Yankee cylinder 3 provides an example of a fibrous web processing apparatus in a fibrous web manufacturing machine and the heated outer surface 4, i.e. the heated cylindrical surface 4, of the Yankee cylinder 3 provides an example of a heated treatment surface of the fibrous web processing apparatus for directing a treatment effect, i.e. in this case the drying effect, directed to the tissue web 2 to be manufactured.

The Yankee cylinder station may also comprise one or more hoods laid next to the outer surface 4 of the Yankee cylinder 3 for blowing heated air against the tissue web 2. In FIG. 1 there is a wet end side hood 16WE and a dry end side hood 16DE. By the hood(s) a moisture profile of the tissue web 2 in a cross direction of the tissue web 2 may be affected.

From the Yankee cylinder 3 the tissue web 2 is forwarded to the pope reel 7, where it is guided a reeling drum (not shown) and rolled up on a reel spool 9 to form a tissue parent roll 8. Between the Yankee cylinder 3 and the pope reel 7 there is a scanner 10, which is a measuring device arranged to travel in the cross direction of the moving tissue web 2 and which comprises at least one sensor for measuring at least one property of the moving tissue web 2. Generally the measured properties of the fibrous web to be manufactured may for example be moisture, temperature, basis weight and gloss of the web.

The scanner 10 comprises an upper measuring head 10*a* located above the moving web 2 and a lower measuring head 10*b* located below the moving web 2. The scanner 10 provides one example of a measuring device which can be configured to measure at least one property of the moving fibrous web. Referring to FIG. 1 the measuring device 10 is located in the direction of the travel of the web immediately next to the Yankee cylinder 3 the operation of which is of interest. Thus a treatment effect performance directed to the tissue web by the heated outer surface 4 of the Yankee cylinder may be monitored by means of at least one measured property of the moving tissue web. The treatment effect performance directed by the Yankee cylinder outer surface 4 to the moving tissue web may, in turn, reveal possible malfunctions in the structure or the operation of the Yankee cylinder 3.

Further referring to the example of FIG. 1 the definition "immediately next to" means that the measuring device 10 is located soon after the point where the web is creped from the Yankee surface so that between the measuring device 10 and the Yankee cylinder 3 there is no web processing apparatus that could effect on the properties of the moving tissue web 2, whereby a treatment effect performance, such as the drying effect performance, directed to the tissue web 2 by the Yankee cylinder 3 may be monitored by means of at least one measured property of the moving tissue web 2. In fact, the scanner 10 is the very same device which is included as a central part of a process automation and machine control system in all modern tissue machines. In other words the measuring device 10, i.e. the scanner 10, provides a main measuring device for a process control of the tissue machine 1. The measuring device 10 thus belongs permanently to the tissue machine 1 and forms a permanent part of it. It has measuring heads on one or both sides of the web to sense and give information of various properties of the web, including caliper, moisture, temperature, basis weight which are in turn used to control the tissue machine and optimize its performance. Scanners of the kind are well known in the art, as an example is given Valmet IQ scanner, the product and the trade name provided and owned by the applicant. The measured data provided by the scanner 10 is now utilized in monitoring of a surface of a rotating component, such as Yankee cylinder. No additional or auxiliary devices such as portable scanners or the like are needed to perform the method of the solution described herein. Further, no additional rails or supports or any efforts for temporary assembly of the device for the purpose of Yankee performance monitoring are needed, either.

With Yankee cylinders 3 for example wear of the outer surface 4 of the Yankee cylinder 3, and a drying effect directed by the heated outer surface 4 of the Yankee cylinder 3, are properties of the Yankee cylinder 3 or its operation which may be of interest. Possibly excessively worn portions of the outer surface 4 of the Yankee cylinder 3, or problems in the condensation water removal out of the Yankee cylinder 3, for example, may cause variations in the drying effect to be directed to the tissue web 2 by the heated outer surface 4 of the Yankee cylinder 3. In order to monitor for example the drying effect performance provided by the heated outer surface 4 of the Yankee cylinder 3 to the tissue web 2, at least moisture of the moving tissue web 2 is measured and the measurement data describing the moisture of the tissue web 2 is processed in order to form a graphical representation describing the drying effect performance provided by the heated outer surface 4 of the Yankee cylinder 3 to the tissue web 2.

Generally, in order to monitor a web processing apparatus, and especially in order to monitor a treatment effect performance provided by the treatment surface of the web processing apparatus to the moving web to be manufactured, at least one property of the moving fibrous web is measured and the measurement data describing the measured property of the fibrous web is processed in order to form a graphical representation describing a treatment effect performance.

The at least one graphical representation said above may be configured to describe a profile of the measured property of the fibrous web in a cross direction of the web as mapped on the treatment surface of the web processing apparatus in a cross direction thereof. Alternatively the at least one graphical representation said above may be configured to describe a profile of the measured property of the fibrous web in a cross direction and a machine direction of the web as mapped on the treatment surface area of the web processing apparatus both in the cross direction and the machine direction thereof. Alternatively the at least one graphical representation said above may be configured to describe a profile of a variation of the measured property of the fibrous web in a cross direction and a machine direction of the web as mapped on the treatment surface area of the web processing apparatus both in the cross direction and the machine direction thereof.

The definition "as mapped" means that a measured value at a certain point of the web is projected to a respective point on the treatment surface of the web processing apparatus preceding the measurement, which method will be explained in detail later. When the graphical representation of the measured property of the fibrous web is mapped on the treatment surface of the web processing apparatus, each measured data item of the measured property of the fibrous web or a data item achieved by processing the measured data item is interrelated to a specific portion in the treatment surface area of the web processing apparatus either in the cross direction CD of the treatment surface area of the web processing apparatus or both in the cross direction CD and in the machine direction MD of the treatment surface area of the web processing apparatus.

According to an embodiment the at least one measured property of the tissue web 2 is a moisture of the tissue web 2 after the Yankee cylinder 3. The drying effect performance directed by the heated outer surface 4 of the Yankee cylinder 3 to the tissue web 2 may be described for example on the basis of the moisture of the tissue web 2 as such or on the basis of the variation of the moisture of the tissue web 2. Any notable variation in the moisture of the tissue web 2 in the cross-direction CD of the tissue web 2 and/or in the machine direction MD of the tissue web 2 may indicate for example a possibly excessively worn portion of the outer surface 4 of the Yankee cylinder 3, a possible malfunction in the supply of the steam into the Yankee cylinder 3 or a possible malfunction in the discharge of the condensation water out of the Yankee cylinder 3.

According to an embodiment the at least one measured property of the tissue web 2 is a temperature of the tissue web 2 after the Yankee cylinder 3. The drying effect performance directed by the heated outer surface 4 of the Yankee cylinder 3 to the tissue web 2 may be described for example on the basis of the temperature of the tissue web 2 as such or on the basis of the variation of the temperature of the tissue web 2. Any notable variation in the temperature of the tissue web 2 in the cross-direction CD of the tissue web 2 and/or in the machine direction MD of the tissue web 2 may indicate for example a possibly excessively worn portion of the outer surface 4 of the Yankee cylinder 3, a possible malfunction in the supply of the steam into the Yankee cylinder 3 or a possible malfunction in the discharge of the condensation water out of the Yankee cylinder 3.

Figure 2:
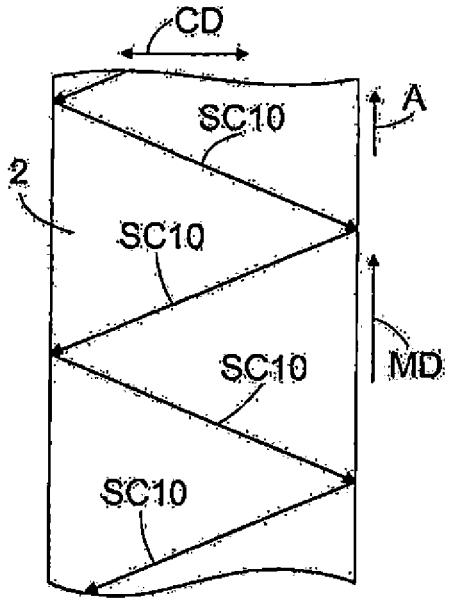
FIG. 2 shows schematically one possible embodiment to measure at least one property of the moving tissue web.

FIG. 2 shows schematically one way to perform a measurement of at least one property of the moving fibrous web. In the embodiment of FIG. 2 the tissue web 2 moves in the machine direction MD, i.e. to the direction indicated with the arrow A. The scanner 10 (not shown in FIG. 2) is moved substantially continuously back and forth in the cross direction CD of the tissue web 2, whereby the scanner 10 moves along a path described by arrows SC10 relative to the moving fibrous web 2. This way of performing the measurement is a typical or a standard way of measuring of the properties of the moving web. In this measurement mode the tissue machine 1 is typically in a normal dynamic running condition, whereby any set values used in the running of the machine 1 may change and operation of different devices in the tissue machine 1 may be controlled accordingly. On the basis of a single measurement operation, where the scanner 10 has traveled from one side edge of the tissue web 2 to the opposing side edge of tissue web 2, a graphical representation having a form of a xy-scatter describing the profile of the property of the tissue web 2 in the cross-direction CD thereof may be provided. By gathering measurement data over very long time, i.e. when the scanner 10 has traveled numerous times back and forth over the tissue web 2 in the cross direction CD thereof, a graphical representation having a form of a contour plot of the property of the tissue web 2 both in the machine direction MD and the cross-direction CD of the tissue web 2 may also be provided.

Figure 3:
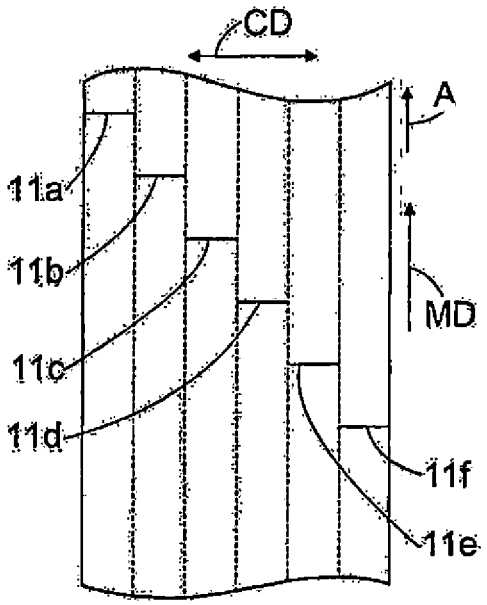
FIG. 3 shows schematically another embodiment to measure at least one property of the moving tissue web.

FIG. 3 shows schematically another way to perform a measurement of at least one property of the moving fibrous web. In the embodiment of FIG. 3 the tissue web 2 moves in the machine direction MD, i.e. to the direction indicated with the arrow A. The scanner 10 (not shown in FIG. 3 either) is moved substantially stepwise in the cross direction CD of the tissue web 2 from one side edge of the tissue web 2 to the opposing side edge of tissue web 2 so that the at least one property of the moving tissue web 2 is measured for a given period of time at one position of the tissue web 2 in the width direction thereof, followed by moving the scanner 10 to the next position of the tissue web 2 in the width direction thereof and measuring the at least one property of the moving tissue web 2 at the next position of the tissue web 2 for the given period of time. This procedure is repeated until the measurement has been completed for the whole width of the tissue web 2 and the opposite side edge of the tissue web 2 has been reached by the scanner 10.

In FIG. 3 in all six measurement positions 11*a*, 11*b*, 11*c*, 11*d*, 11*e*, 11*f* are disclosed but in practice the number of measurement positions is substantially higher in a practical implementation. For the measurement mode of FIG. 3 the tissue machine 1 is controlled to regular or constant running condition, whereby all devices in the tissue machine 1, such as the hood(s), the headbox, the suction roll, drives etc. are running in stable condition so that no intended changes in the properties of the moving tissue web 2 to be manufactured appear during the measurement procedure of FIG. 3.

Referring to FIG. 1 again, for being able to do the mapping between the heated outer surface 4 of the Yankee cylinder 3 and the measured property of the tissue web 2 in the cross direction CD of the outer surface 4 of the Yankee cylinder 3, only the position of the scanner 10 relative to the web 2 needs to be known.

However, for being able to do the mapping between the heated outer surface 4 of the Yankee cylinder 3 and the measured property of the tissue web 2 both in the cross direction CD and in the machine direction MD of the heated outer surface 4 of the Yankee cylinder 3, the speed of the tissue web 2 at the scanner 10 and the speed of the tissue web 2 at the Yankee cylinder 3 have also to be known.

The need to determine the speed of the tissue web 2 at two different points in the tissue machine 1 originates from the soft nature of the tissue web 2, because of which the appearance of the tissue web 2 is different at the Yankee cylinder 3 from that of at the scanner 10 or at the pope reel 7. At the Yankee cylinder 3 the tissue web 2 is attached very firmly and very evenly against the outer surface 4 of the Yankee cylinder 3 on which it dries. However, during the creping process i.e., when the tissue web 2 is detached or scraped off from the outer surface 4 of the Yankee cylinder 3 with a creping blade 6, crepe folds are generated on the tissue web 2 making it stretchable such that the web 2 can be transferred from the Yankee cylinder 3 to the reel 7 without a web break. Therefore, in order to be able to map a specific measured point of the thus stretched tissue web 2 to a specific point at the Yankee cylinder 3 outer surface 4, the speed of the tissue web 2 both at the Yankee cylinder 3 outer surface 4 and at the scanner 10 should be known. On the basis of this speed data together with the measurement data describing the property of the moving tissue web 2, a graphical representation having a form of a contour plot of the property of the tissue web 2 both in the machine direction MD and the cross-direction CD of the tissue web 2 may be provided, wherein each single measurement result or a further processed value of the measurement result of the property of the moving tissue web 2 is mapped or aligned with a specific spot on the outer surface 4 of the Yankee cylinder 3.

Referring back to FIG. 1, the arrangement for monitoring the Yankee cylinder 3 and the treatment effect performance thereof comprises a first measuring unit 12 for measuring a variable describing the speed of the tissue web 2 at the scanner 10. The first measuring unit 12 may be arranged at the pope reel 7 for measuring a rotation speed RS7 of the pope reel 7, the rotation speed of the pope reel 7 being a variable describing a travel speed of the tissue web 2 at the scanner 10, because the travel speed of the tissue web 2 at the scanner 10 and at the pope reel 7 are the same. The first measuring unit 12 may for example comprise a sensor element arranged at a frame of the pope reel 7 and a counter element arranged at the reel spool 9, for example, whereby a rotation speed RS7 of the pope reel 7 may be determined by the number of revolutions i.e. the times the counter element goes past to the sensor element at a predetermined time period. When the travel speed of the tissue web 2 at the scanner 10 is to be determined on the basis of the rotation speed of the pope reel 7, the diameter of the roll 8 is to be taken into account because when the diameter of the roll 8 at the pope reel 7 increases, the rotation speed RS7 of the pope reel 7 decreases, what must also be taken into account in the determination of the travel speed of the tissue web 2 at the scanner 10.

Still referring back to FIG. 1, the arrangement for monitoring the Yankee cylinder 3 and the treatment effect performance thereof comprises also a second measuring unit 13 for measuring a variable describing the speed of the tissue web 2 at the Yankee cylinder 3. The second measuring unit 13 may be arranged at the Yankee cylinder 3 for measuring a rotation speed RS3 of the Yankee cylinder 3, the rotation speed of the Yankee cylinder 3 being a variable describing a travel speed of the tissue web 2 at the Yankee cylinder 3. The second measuring unit 13 may for example comprise a sensor element arranged at a frame of the Yankee cylinder 3 and a counter element arranged at a specific location at the Yankee cylinder 3, whereby the rotation speed RS3 of the Yankee cylinder 3 may be determined by the number of revolutions i.e. the times the counter element goes past to the sensor element at a predetermined time period. One possible location for the counter element at the Yankee cylinder 3 could be at the manhole 14 that allows an entrance inside the Yankee cylinder 3. The measured rotation speed RS3 of the Yankee cylinder 3 is to be converted to a circumferential speed of the Yankee cylinder 3 for determining the travel speed of the moving tissue web 2 by taking into account the diameter of the Yankee cylinder 3.

The arrangement further comprises a data processing unit 15. The data processing unit 15 is configured to receive the variable describing the travel speed of the moving web 2 at the scanner 10, i.e. the travel speed of the moving web 2 at the pope reel 7, through a wired or a wireless communication channel CC7. Further the data processing unit 15 is configured to receive the variable describing the travel speed of the moving web 2 at the Yankee cylinder 3, through a wired or a wireless communication channel CC3. Furthermore, the data processing unit 15 is configured to receive from the scanner 10 the measurement data describing the at least one measured property of the moving tissue web 2 through a wired or a wireless communication channel CC10.

The data processing unit 15 is configured to process the measurement data describing the at least one measured property of the moving tissue web 2 in order to form a graphical representation describing a treatment effect performance provided by the heated treatment surface, i.e. the outer surface 4, of the Yankee cylinder 3 to the web 2 to be manufactured. The data processing unit 15 may comprise a wired or a wireless communication channel CC15 to send the determined graphical representation to a display unit either at the data processing unit 15 itself or at some other location in the factory or outside of it.

The data processing unit 15 may for example be a computer which is normally used to monitor and control operations in the tissue machine 1 or it may be for example a separate portable computer that comprises necessary software to carry out operations and computations needed to provide the graphical presentations desired.

FIGS. 4*a*, 4*b*, 5*a*, 5*b*, 6*a*, 6*b*, 7*a* and 7*b* show some examples of graphical representations describing a treatment effect performance provided by a heated outer surface 4 of a Yankee cylinder 3 to the tissue paper web 2 to be manufactured.

Figure 4A:
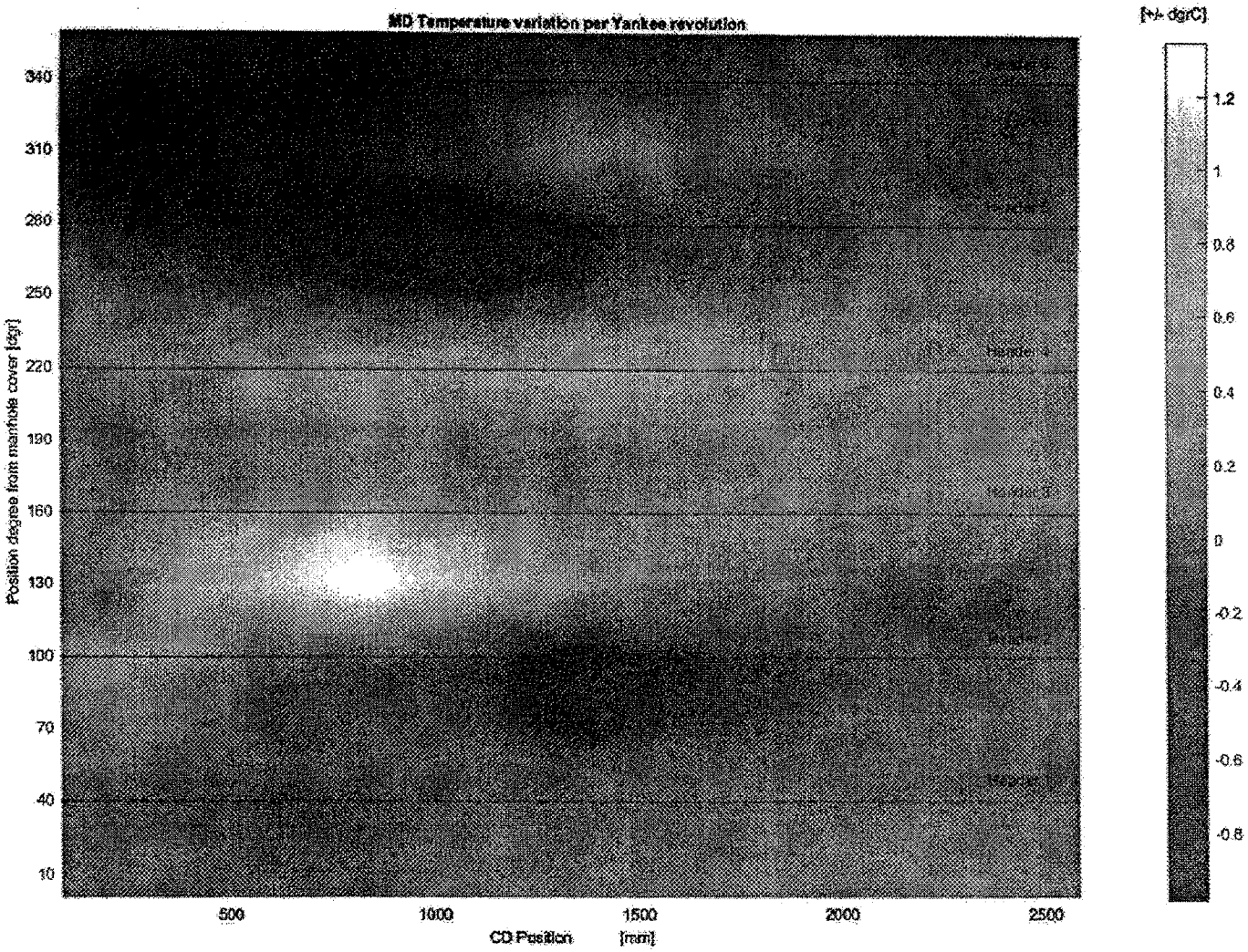
FIGS. 4*a*, 4*b*, 5*a*, 5*b*, 6*a*, 6*b*, 7*a* and 7*b* show some examples of graphical representations describing a treatment effect performance provided by a heated outer surface of the Yankee cylinder to the tissue paper web to be manufactured.
Figure 4B:
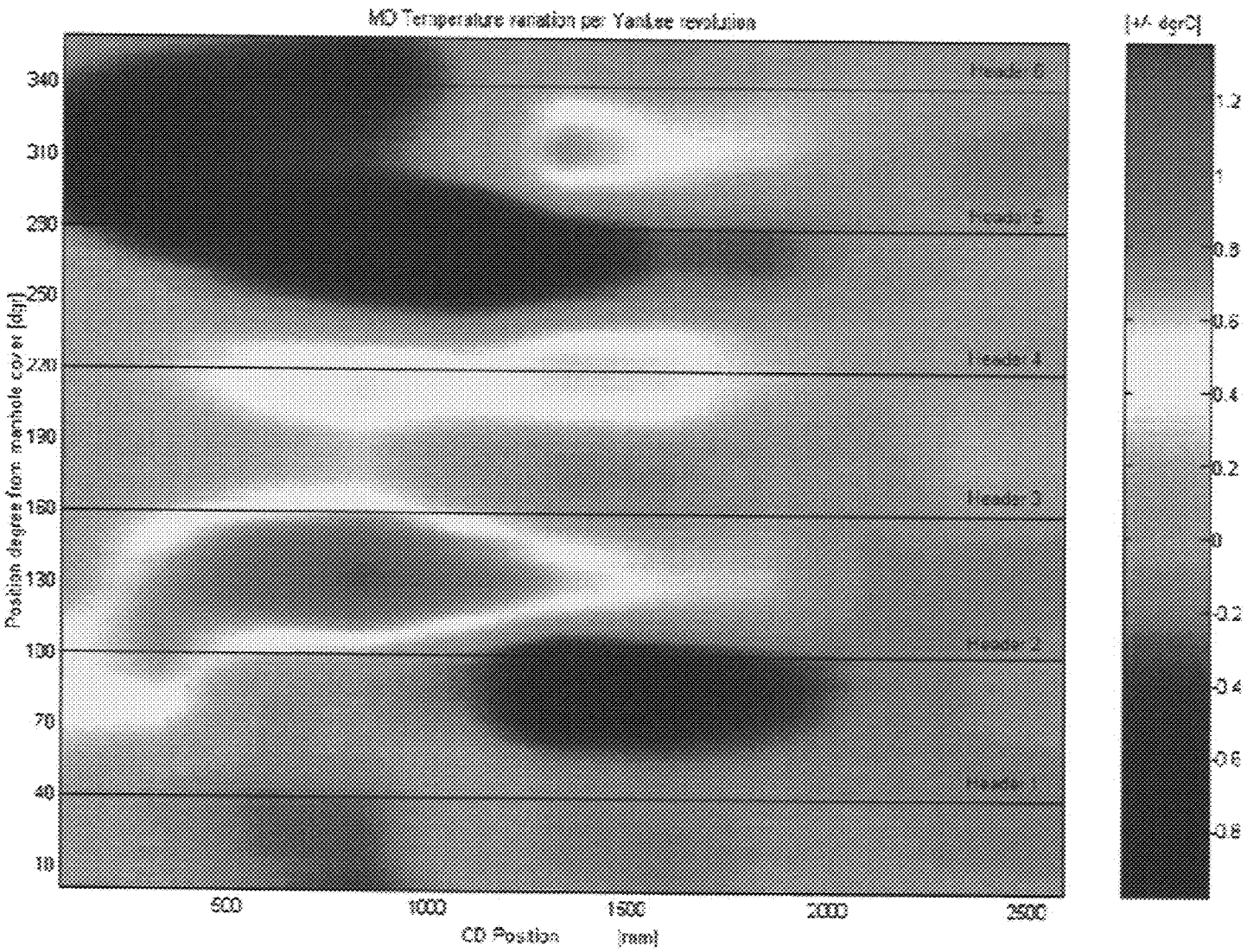
Figure 5A:
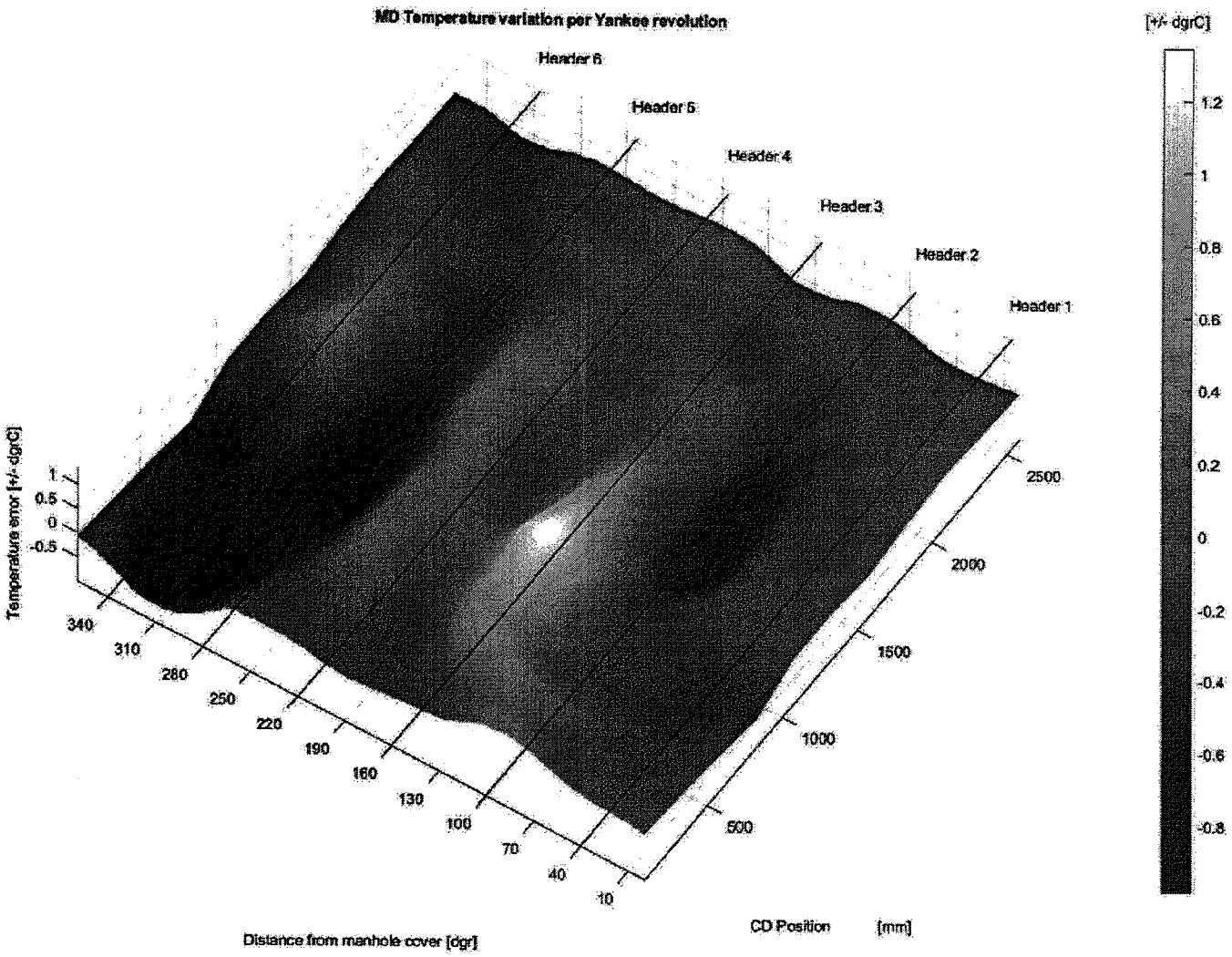
Figure 5B:
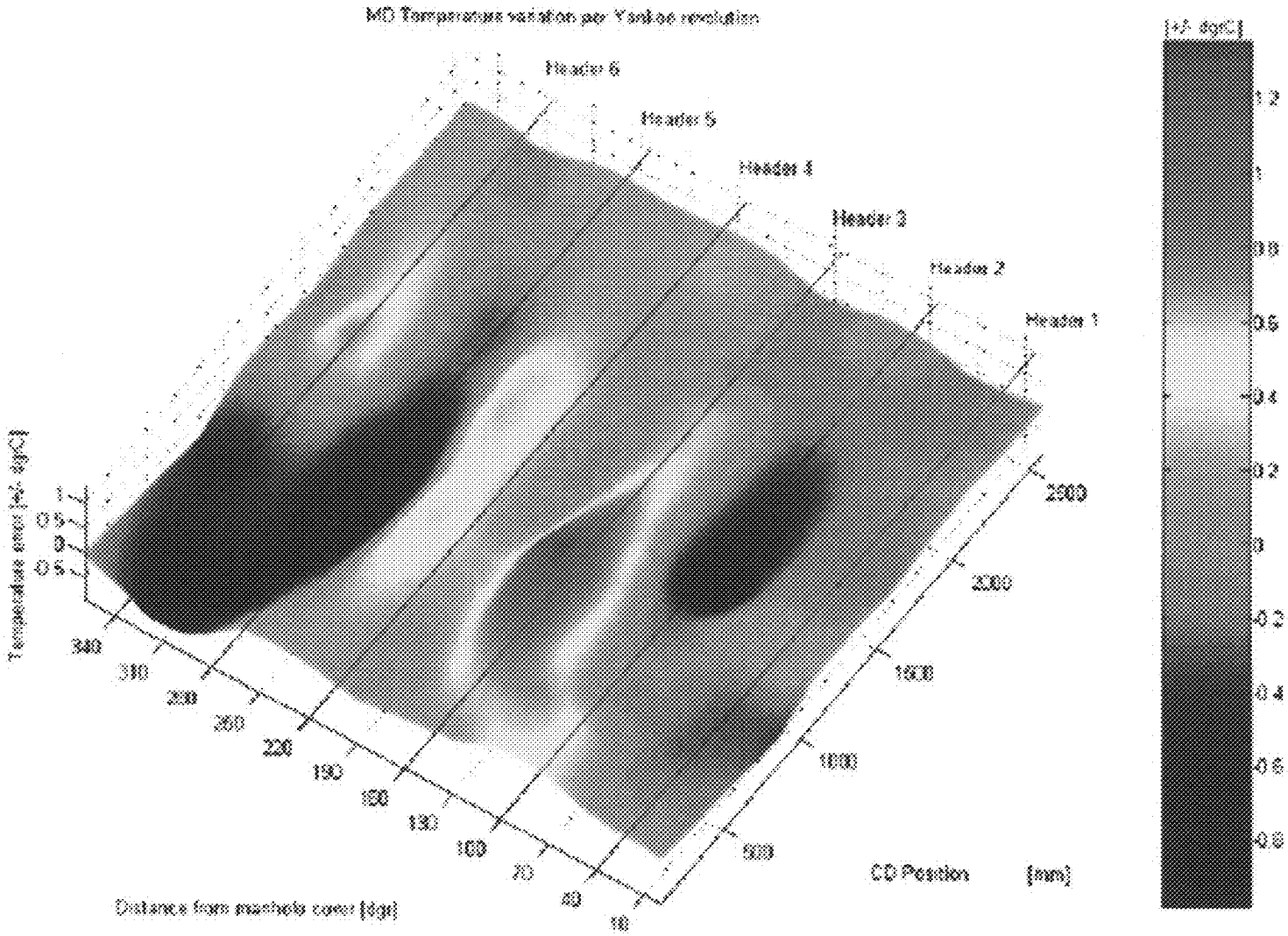

FIG. 4*a* discloses on the left side a 2D grey scale illustration of tissue web temperature variation in the cross direction CD and the machine direction MD of the tissue web 2 as mapped to an area corresponding to the heated outer surface 4 of the Yankee cylinder 3. On the right side there is presented a grey scale bar that provides a numerical measure for the temperature variation presented by the grey scale presentation of the left side picture. FIG. 4*b* discloses the same in colors. FIG. 5*a* discloses the same measurement data but with a 3D grey scale contour surface plot and FIG. 5*b* discloses the same in colors.

From FIGS. 4*a*, 4*b*, 5*a* and 5*b* it may be visually observed that in the area near the front edge of the outer surface 4 of the Yankee cylinder 3 relating to the header 2 there is an area which seems to cause the temperature of the tissue web 2 to be somewhat higher than in the most part of the tissue web 2. This area can be seen as a light grey area in FIGS. 4*a* and 5*a* and as a dark red area in FIGS. 4*b* and 5*b*. Similarly it may be visually detected that in the area near the middle of the outer surface 4 of the Yankee cylinder 3 relating to the header 1, in the area near the middle of the outer surface 4 of the Yankee cylinder 3 relating to the header 4 and in the area near the front edge of the outer surface 4 of the Yankee cylinder 3 relating to the headers 5 and 6 there is an area that seems to cause the temperature of the tissue web 2 to be somewhat lower than in the most part of the tissue web 2. These areas can be seen as dark grey areas in FIGS. 4*a* and 5*a* and dark blue areas in FIGS. 4*b* and 5*b*. These pieces of information may indicate a problem in the condition of the outer surface 4 of the Yankee cylinder 3 or in the condensation water removal from the respective header of the Yankee cylinder.

Figure 6A:
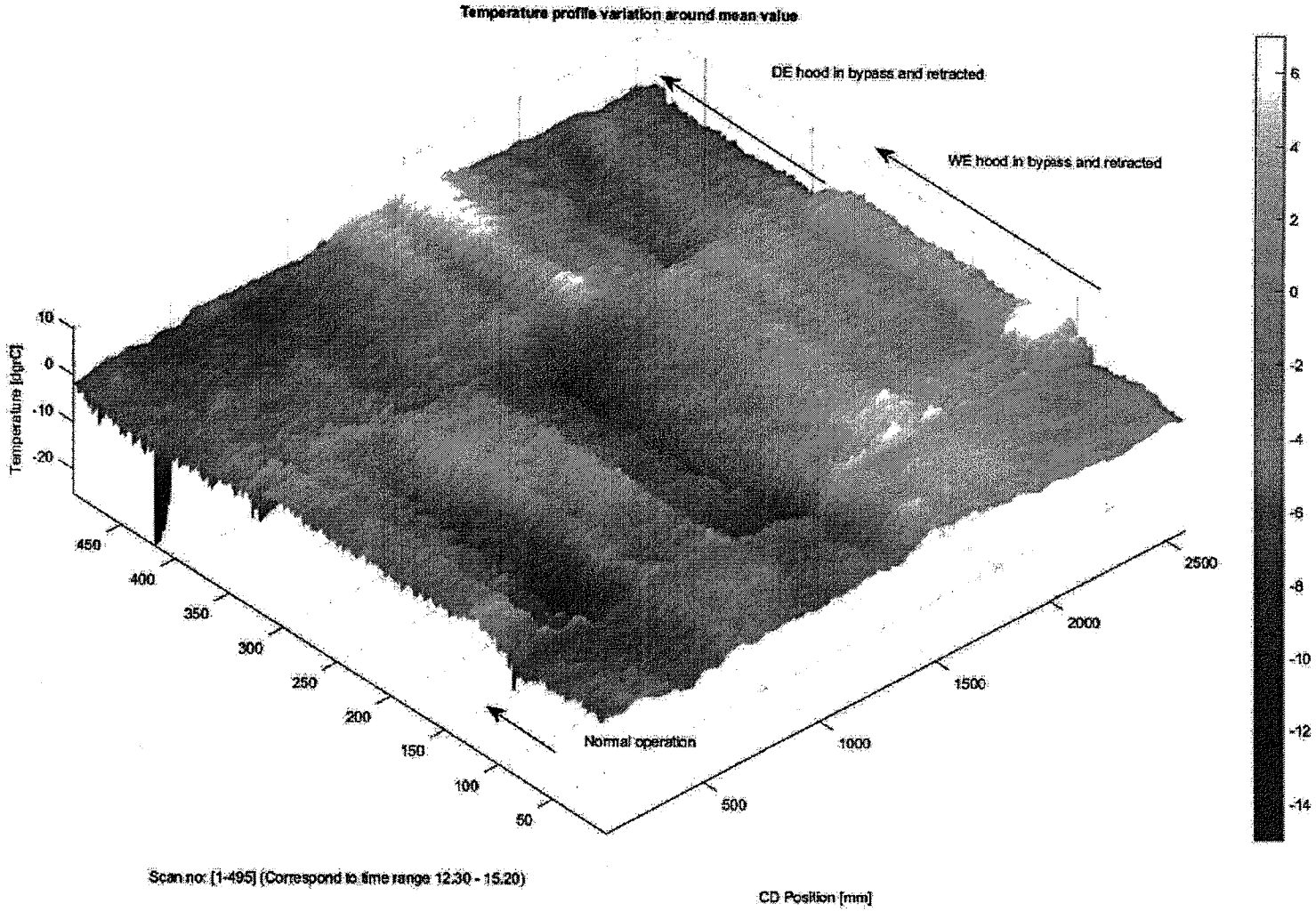
Figure 6B:
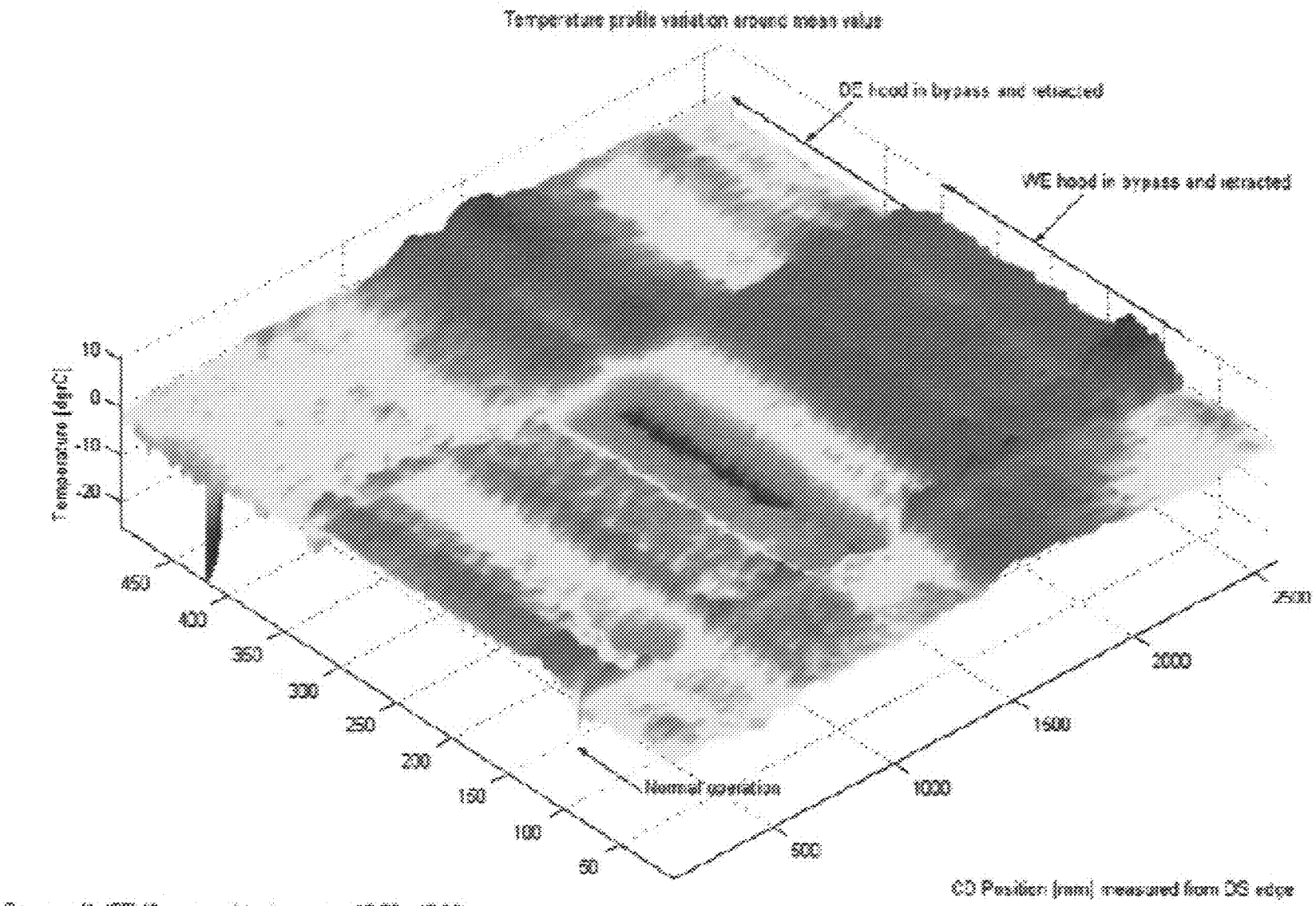

FIG. 6*a* discloses a 3D grey scale contour surface plot illustration of tissue web 2 temperature variation around a mean value in the cross direction CD of the tissue web 2 with 495 different successive measurements. FIG. 6*b* disclosed the same in colors. From FIGS. 6*a* and 6*b* it can be seen that during normal operation (portion titled "Normal operation" in FIGS. 6*a* and 6*b*) of the Yankee cylinder with the wet end side hood 16WE and the dry end side hood 16DE being in operation, i.e. about first 150 measurements, there is an area in the cross direction position of about 1800 mm-2200 mm, wherein the temperature of the tissue web is somewhat higher than in other portions of the tissue web 2 in the cross direction thereof. This area can be seen as a light grey area in FIG. 6*a* and as a dark red area in FIG. 6*b*.

When the wet end hood 16WE is taken out of operation (portion titled "WE hood in bypass and retracted" in FIGS. 6*a* and 6*b*), it can be observed that the temperature of the tissue web is somewhat higher in the area corresponding to substantially half of the width of the tissue web at the back end side portion of the tissue web 2 in the cross direction thereof. This area can be seen as a light grey area in FIG. 6*a* and as a dark red area in FIG. 6*b*.

When the dry end hood 16DE is taken out of operation (portion titled "DE hood in bypass and retracted" in FIGS. 6*a* and 6*b*), and the wet end hood 16DE is in operation again, it can be observed that the temperature of the tissue web is somewhat higher in the area corresponding to substantially middle area of the width of the tissue web 2 in the cross direction thereof. This area can be seen as a light grey area in FIG. 6*a* and as a dark red area in FIG. 6*b*.

From FIGS. 6*a* and 6*b* it can be seen how the effects of the operation of the hoods to the property of the tissue web 2, in this case to the temperature of the tissue web 2, can be visually inspected. By taking at least one hood out of operation at a time the effect of the respective hood to the tissue web 2 may be eliminated, whereby the effect of the Yankee cylinder outer surface to the properties of the tissue web 2 is emphasized and possible malfunctions in the outer surface of the Yankee cylinder or in the operation of the Yankee cylinder condensation water removal, for example, may be visually observed from the graphical presentation.

Figure 7A:
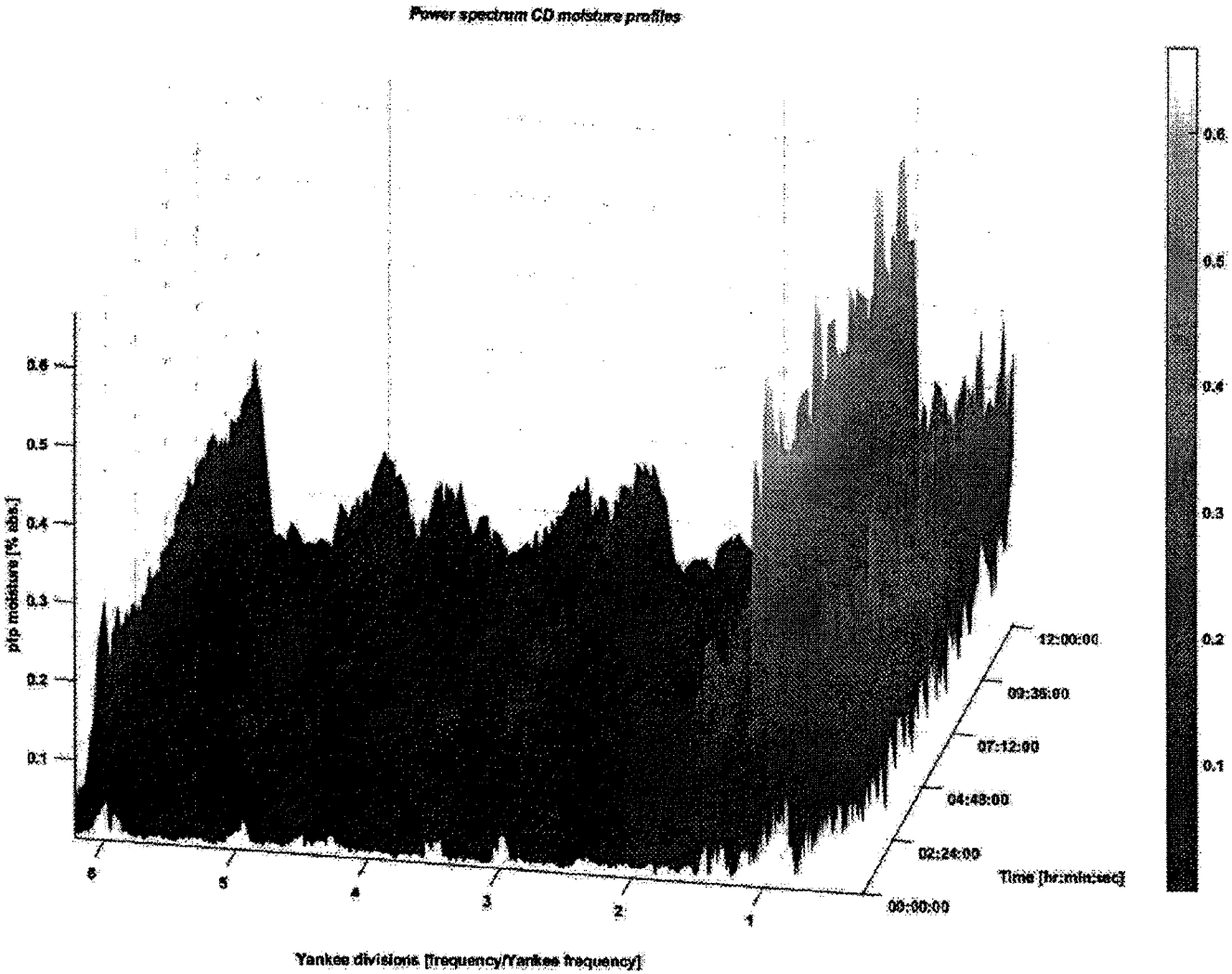
Figure 7B:
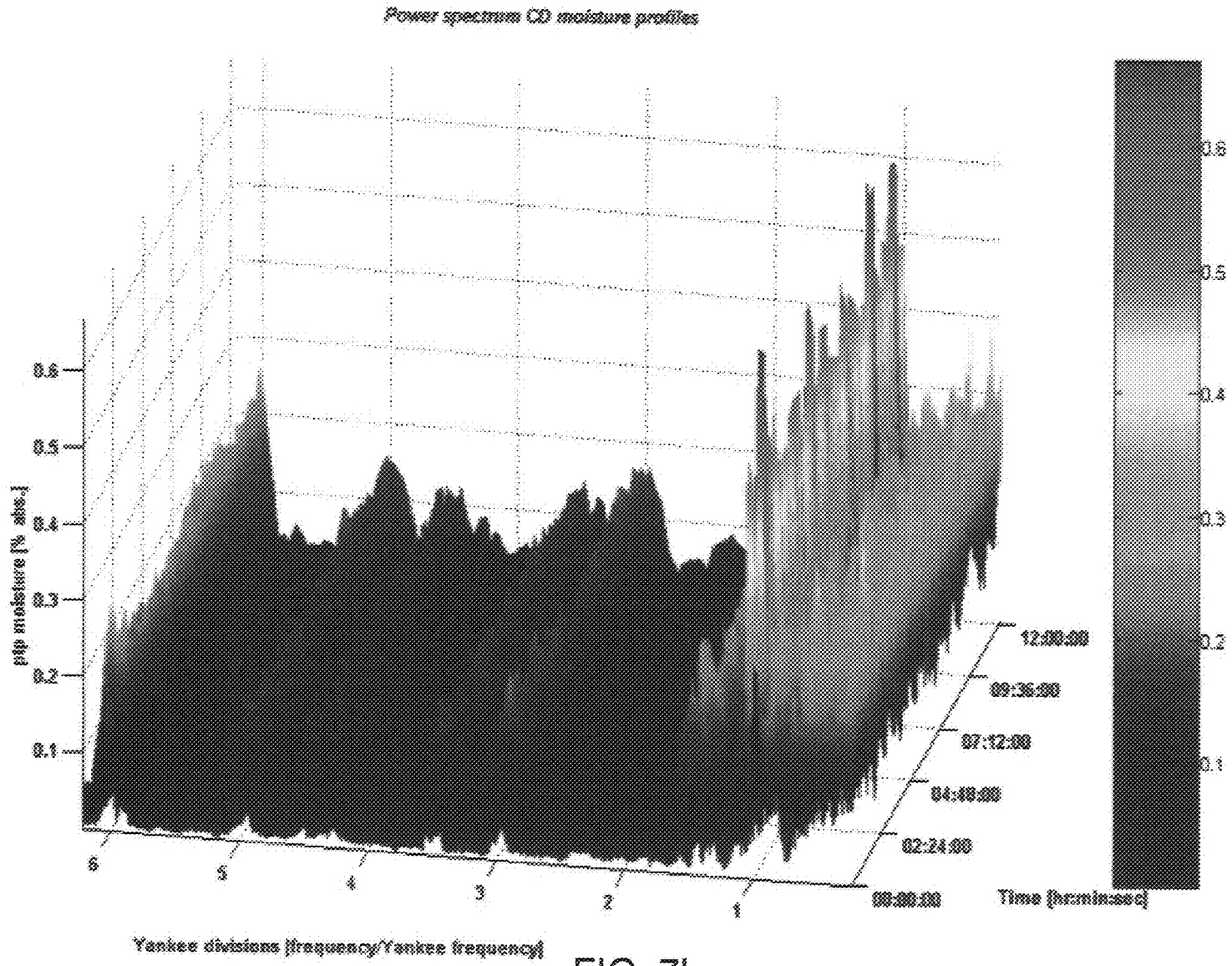

FIG. 7*a* discloses a 3D grey scale contour surface plot illustration of tissue web 2 power spectrum cross direction moisture profile presenting a peak-to-peak moisture of the tissue web 2 in respect of the Yankee divisions, i.e. frequency per Yankee frequency. FIG. 7*b* discloses the same in colors. FIGS. 7*a* and 7*b* show a global peak at Yankee division point 1, illustrating that moisture profile variation of the tissue web 2 originates mainly from the operation of the Yankee cylinder station. However, FIGS. 7*a* and 7*b* show also some local peaks, such as at Yankee division points 3 and 5. This may indicate some problems in the operations of other apparatuses than the Yankee cylinder, i.e. apparatuses having an operation speed of about three times or five times of that of the Yankee cylinder. The measurements may thus be utilized also to detect possible problems in other apparatuses than only the Yankee cylinder or to ensure sometimes that the quality etc. problems are not originated of Yankee malfunctions.

With the solution disclosed the treatment effect performance, such as the drying effect, of the Yankee cylinder outer surface to the tissue web may be visually illustrated, whereby an operator either inside or outside of the factory may consider whether the operation of the Yankee cylinder is normal or not, and thereby detect possible defects or malfunctions in the Yankee cylinder outer surface or in the operation of the Yankee cylinder and consider a reason for the possible malfunctions. The inspection is based on the measured properties of the tissue web to be manufactured and not to the properties of the Yankee cylinder itself or the operation thereof, whereby the measurements needed may be carried out by measurement device or instruments already normally available in the tissue machine. This means that no specific measurement instruments or measurement arrangements are needed to carry out the solution presented.

Figure 8:
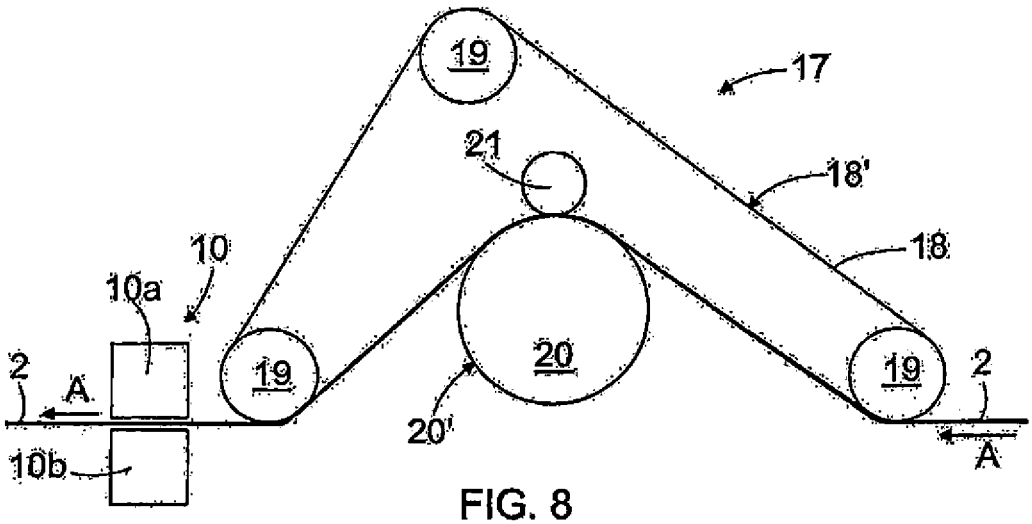
FIG. 8 shows schematically a side view of a metal belt calendar.

FIG. 8 shows schematically a side view of a metal belt calender 17 applicable to be used in many paper or board machines. The metal belt calender 17 provides an example of a second fibrous web processing apparatus. The metal belt calender 17 comprises a calendering belt 18 rotating around guide rolls 19. Outside the calendering belt 18 loop there is a counter roll 20, whereby a web processing zone is formed between the calendering belt 18 and the counter roll 20. Furthermore inside the calendering belt loop there is a nip roll 21 acting as a pressing means that presses the calendaring belt 18 against the counter roll 20, whereby a zone with higher pressure is formed between the calendering belt 18 and the counter roll 20. The counter roll 20 may be heated, i.e. it is a kind of a thermo roll.

The metal belt calender 17 of FIG. 8 may be used as a calender, a drying apparatus, a press, a coating apparatus, a sizing apparatus or a printing apparatus, for example. The metal belt calender 17 comprises actually two treatment surfaces for directing a treatment effect to the moving web 2 to be manufactured, i.e. an outer surface 18' of the calendering belt 18 directed towards the counter roll 20 and an outer surface 20 of the counter roll 20. When the measuring device, such as the scanner 10, is located immediately next to the metal belt calender 17 in the direction of the travel of the fibrous web, a graphical representation relating at least one measured value of the at least one property of the moving web to the rotating component to be monitored, i.e. to at least one portion of either the outer surface 18' of the calendaring belt 18 or the outer surface 20' of the counter roll 20, may be provided in a similar way as disclosed above. If the counter roll 20 is heated, it heats the calendering belt 18 too, whereby the metal belt calender 17 may comprise two heated treatment surfaces, i.e. the outer surface 18' of the calendering belt 18 and the outer surface 20' of the counter roll 20.

Because no substantial stretching of the fibrous web takes place in the metal belt calender 17, only one speed measuring unit for determining the travel speed of the fibrous web is needed in this embodiment. The travel speed of the fibrous web may for example be measured at the pope reel 7 as disclosed above. It will be obvious to a person skilled in the art that, as the technology advances, the inventive concept can be implemented in various ways. The invention and its embodiments are not limited to the examples described above but may vary within the scope of the claims.

We claim:

1. A method for monitoring a Yankee cylinder, comprising the steps of:

directing a treatment effect on a moving tissue web (2) to be manufactured by a Yankee cylinder (3) arranged in a tissue machine (1) for manufacturing the tissue web (2), the Yankee cylinder (3) comprising a heated outer surface (4) for directing the treatment effect to the moving tissue web (2) to be manufactured;

determining the speed of the moving tissue web on the Yankee cylinder;

measuring at least one property of the moving tissue web (2) by a measuring device (10) being a permanent part of the tissue machine (1) and providing the measuring device for a process control of the tissue machine (1), the measuring device (10) being arranged in the tissue machine (1) immediately next to the Yankee cylinder (3) in the direction of the travel of the web (2) to be manufactured;

determining the speed of the tissue web at the measuring device (10); and using the determined speed of the tissue web on the Yankee cylinder and the determined speed of the tissue web at the measuring device to form a graphical representation describing a treatment effect performance provided by the heated outer surface (4) of the Yankee cylinder (3) mapped to the moving tissue web (2) to be manufactured on the basis of the at least one measured property of the web (2) by at least one data processing unit (15) configured to process measurement data describing the at least one measured property of the web (2) to form a plurality of measurement results.

2. The method of claim 1 wherein the measuring device (10) is controlled to traverse substantially continuously along a cross direction (CD) of the moving web (2) when measuring the at least one property of the moving web (2).

3. The method of claim 1 wherein the measuring device (10) is controlled to traverse substantially discontinuously along a cross direction (CD) of the moving web (2) when measuring the at least one property of the moving web (2).

4. The method of claim 1 wherein the graphical representation has a form of a contour plot of the at least one property of the moving tissue web (2) both in a machine direction MD and a cross-direction CD of the moving tissue web (2), and wherein each of the plurality of measurement results or a further processed value of the measurement results of the property of the moving tissue web (2) is mapped or aligned with a specific spot on the outer surface (4) of the Yankee cylinder (3).

5. A method for monitoring a Yankee cylinder within a tissue machine, comprising the steps of:

causing a moving web to pass over the Yankee cylinder in a machine direction, wherein the Yankee cylinder has a heated outer surface which heats the moving web as it passes over the Yankee cylinder;

creping the moving web from the Yankee cylinder;

measuring temperature of the moving web or moisture content of the moving web by at least one measuring device which is a permanent part of the tissue machine, the at least one measuring device being arranged in the tissue machine and located after a point where the web is creped from the Yankee surface so that between the measuring device and the creping on the Yankee cylinder there is no web processing apparatus that has a significant effect on the properties of the moving tissue web before the measuring device;

forming a graphical representation corresponding to an effect the Yankee cylinder has on the moving web temperature or moisture content as measured by the at least one measuring device, said graphical representation being formed by at least one data processing unit configured to process measurement data from the at least one measuring device; and measuring a first variable corresponding to a first speed of the moving web on the Yankee cylinder and measuring a second variable corresponding to a second speed of the moving web as the moving web passes by the at least one measuring device and providing the graphical representation of web temperature or moisture content so that it relates to at least one portion of the heated outer surface of the Yankee cylinder on the basis of the second speed multiplied by the first speed divided by the second speed.

6. The method of claim 5 wherein the measuring device is controlled to traverse substantially continuously along a cross direction (CD) of the moving web when measuring the moving web temperature or moisture.

7. The method of claim 5 wherein the measuring device is controlled to traverse substantially discontinuously along a cross direction (CD) of the moving web when measuring the moving web temperature or moisture.

8. The method of claim 5 wherein the graphical representation forms a contour plot of the temperature or moisture content of the tissue web both in the machine direction MD and the cross-direction CD of the tissue web (2), and wherein the step of measuring temperature of the moving web or moisture content of the moving web by at least one measuring device produces a plurality of measurement results, and wherein each measurement result, or a further processed value of the measurement result of the property of the moving tissue web is within the graphical representation mapped or aligned with a specific spot on the outer surface of the Yankee cylinder.

9. The method of claim 5 wherein the graphical representation forms a power spectrum plot of the moisture of the tissue web in a machine direction MD of the tissue web over a selected period of time.

10. A method for monitoring a Yankee cylinder, comprising the steps of:

directing a treatment effect on a tissue web (2) to be manufactured by a Yankee cylinder (3) arranged in a tissue machine (1) for manufacturing the tissue web (2), the Yankee cylinder (3) comprising a heated outer surface (4) for directing the treatment effect to the moving web (2) to be manufactured;

measuring at least one property of the moving web (2) by a measuring device (10) being a permanent part of the tissue machine (1) and providing a measuring device for a process control of the tissue machine (1), the measuring device (10) being arranged in the tissue machine (1) immediately next to the Yankee cylinder (3) in the direction of the travel of the web (2) to be manufactured;

forming a graphical representation describing a treatment effect performance provided by the heated outer surface (4) of the Yankee cylinder (3) to the moving web (2) to be manufactured on the basis of the at least one measured property of the web (2) by at least one data processing unit (15) configured to process measurement data describing the at least one measured property of the web (2); and measuring a variable describing a speed of the moving web (2) and providing the graphical representation that relates at least one measured value of the at least one property of the moving web (2) to at least one portion of the heated outer surface (4) of the Yankee cylinder (3) on the basis of the measured value describing the speed of the moving web (2).

11. A method for monitoring a Yankee cylinder, comprising the steps of:

directing a treatment effect on a tissue web (2) to be manufactured by a Yankee cylinder (3) arranged in a tissue machine (1) for manufacturing the tissue web (2), the Yankee cylinder (3) comprising a heated outer surface (4) for directing the treatment effect to the moving web (2) to be manufactured;

measuring at least one property of the moving web (2) by a measuring device (10) being a permanent part of the tissue machine (1) and providing a measuring device for a process control of the tissue machine (1), the measuring device (10) being arranged in the tissue machine (1) immediately next to the Yankee cylinder (3) in the direction of the travel of the web (2) to be manufactured;

forming a graphical representation describing a treatment effect performance provided by the heated outer surface (4) of the Yankee cylinder (3) to the moving web (2) to be manufactured on the basis of the at least one measured property of the web (2) by at least one data processing unit (15) configured to process measurement data describing the at least one measured property of the web (2); and measuring a variable describing a speed of the moving web (2) at the measuring device (10), measuring a variable describing a speed of the moving web (2) at the Yankee cylinder (3), and wherein the graphical representation that relates at least one measured value of the at least one property of the moving web (2) to at least one portion of the heated outer surface (4) of the Yankee cylinder (3) is formed on the basis of the measured values describing the speed of the moving web (2) at the measuring device (10) and at the Yankee cylinder (3).

* * * * *